US005129034A

United States Patent [19]

Sydenstricker

[11] Patent Number: 5,129,034

[45] Date of Patent: Jul. 7, 1992

[54] ON-DEMAND HOT WATER SYSTEM

[76] Inventor: Leonard Sydenstricker, Rte. 4, Box 758, Silver Springs, Fla. 32688

[21] Appl. No.: 447,637

[22] Filed: Dec. 8, 1989

[51] Int. Cl.[5] ..... H05B 1/02; F24H 1/10

[52] U.S. Cl. ..... 392/486; 219/496; 392/488; 392/490

[58] Field of Search ..... 219/306, 307, 308, 309, 219/303, 304, 496; 392/465, 480, 482, 485-490

[56] References Cited

U.S. PATENT DOCUMENTS

| | | | |
|---|---|---|---|
| 1,744,716 | 1/1930 | Antonelli | 219/306 X |
| 2,419,429 | 4/1947 | Violes | 219/39 |
| 2,825,791 | 3/1958 | Jackson | 219/39 |
| 2,911,511 | 11/1959 | Megarry | 219/306 X |
| 2,973,424 | 2/1961 | Schomann | 219/309 |
| 3,898,428 | 8/1975 | Dye | 219/305 |
| 4,185,187 | 1/1980 | Rogers | 219/306 |
| 4,567,350 | 1/1986 | Todd, Jr. | 219/298 |
| 4,594,500 | 6/1986 | Wright | 219/296 |
| 4,604,515 | 8/1986 | Davidson | 219/298 |
| 4,808,793 | 2/1989 | Hurko | 219/306 |

FOREIGN PATENT DOCUMENTS

| | | | |
|---|---|---|---|
| 3039383 | 5/1982 | Fed. Rep. of Germany | 219/309 |

*Primary Examiner*—Anthony Bartis
*Attorney, Agent, or Firm*—Olson & Hierl

[57] ABSTRACT

An on-demand electric water heater includes at least one heating chamber having an electric heating element operatively positioned between a cold water inlet and a hot water outlet. The heating elements are controlled by pressure sensing switches activated by water flow initiation or termination. A pressure relief valve is provided as a safety feature in the event the pressure sensing switches fail.

2 Claims, 1 Drawing Sheet

ON-DEMAND HOT WATER SYSTEM

TECHNICAL FIELD

The present invention relates generally to the field of water heaters and more specifically to an on-demand hot water system.

BACKGROUND OF THE INVENTION

Conventional water heating systems of the type used in most residences include relatively large holding tanks that contain enough water to supply a predetermined volume of heated water for a given period of time. The water is slowly heated to the desired temperature and then maintained at that temperature until needed. These conventional water heating systems typically require a significant amount of space and waste energy by maintaining the water at an elevated temperature for an extended period of time.

In response to these problems, a number of on-demand heaters have been developed. A major concern in the design of these heaters has been the inadequate flow rates through the system. One solution has generally involved the use of multiple heating chambers. A typical example is found in U.S. Pat. No. 4,567,350 which issued to Todd, Jr.

A second major concern is the most efficient method for controlling such a system. Most devices currently employ temperature control mechanisms. Some employ a mixture of temperature control mechanisms and pressure switch control devices as, for example, in the Todd, Jr. patent. The lack of sensitivity of these systems to pressure changes is still a major concern.

An additional problem with devices such as the device disclosed by Todd, Jr. is the necessity of replacing the entire unit if the volume and usage requirements change. Currently, the installation of a larger hot water heating unit may be necessary to accommodate increased usage requirements.

SUMMARY OF THE INVENTION

The present invention relates to an on-demand hot water system which passes the water through at least one and preferably through a series of heating chambers. Each heating chamber includes an electrical heating element which is activated when the water begins to flow as a tap is opened.

The activating devices are pressure sensing switches for turning the heater on when the pressure drops below a certain high threshold. The heaters will remain on until the pressure increases beyond the high threshold or until the pressure drops below a low threshold. The high threshold will only be reached if the taps are shut off or if the pressure increases because of an overheating of the water. The low threshold is a safety mechanism to shut the hot water heater off in the event it loses too much water pressure for whatever reason.

It is an object of this invention to replace the conventional control mechanisms used in on-demand hot water heaters with a pressure sensitive control mechanism.

It is another object of the invention to deliver hot water within a narrow range of temperatures.

It is a further object of the invention to allow for simple, inexpensive and quick changes to be made to the water heating system depending on the requirements of the user.

Other advantages of the present device will become apparent from the following description of a preferred embodiment and the accompanying drawings.

BRIEF DESCRIPTION OF THE DRAWINGS

In the drawings which comprise a part of this disclosure.

DESCRIPTION OF A PREFERRED EMBODIMENTS

Figure 1:
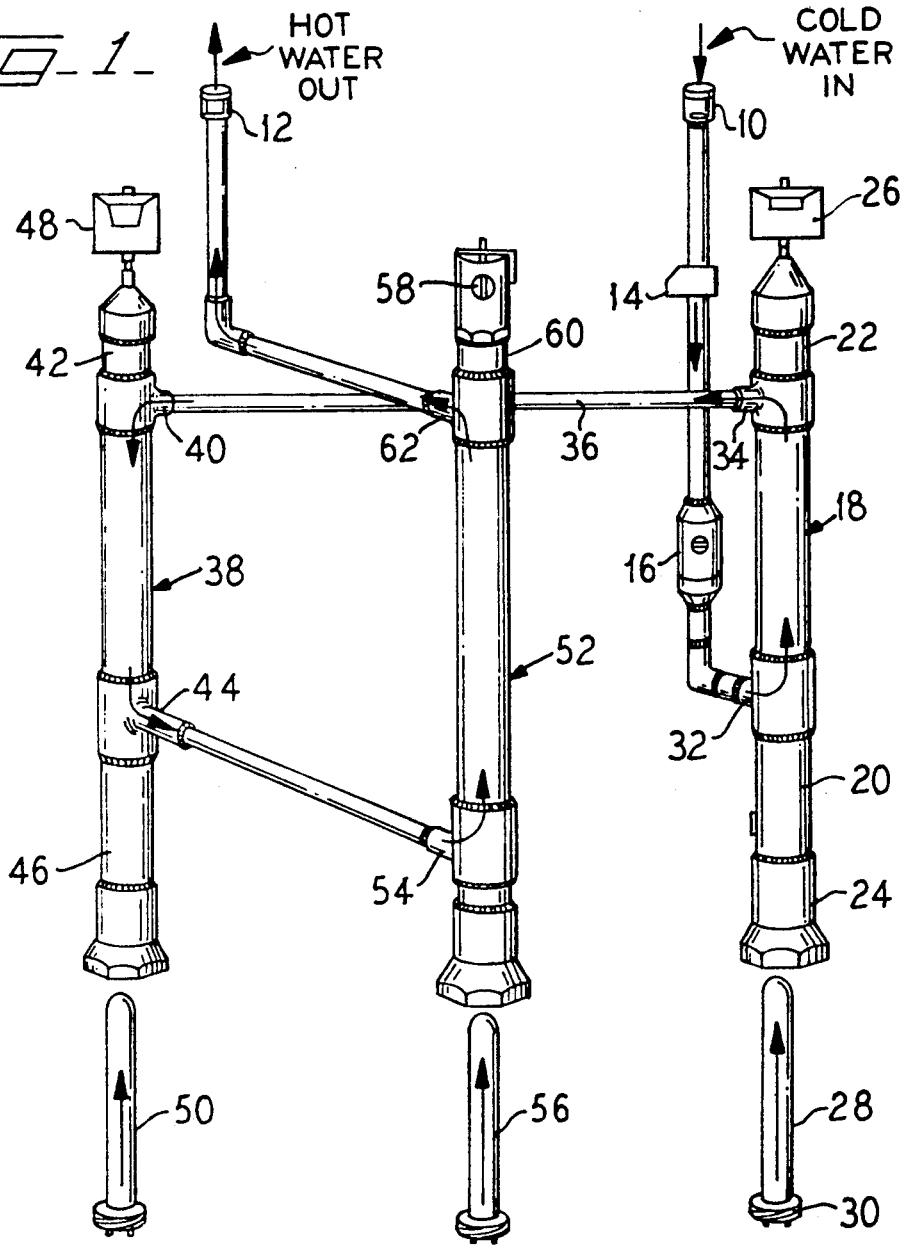
FIG. 1 is a perspective view of the apparatus.

Referring to FIG. 1, an on-demand hot water heater having a cold water inlet 10 and a hot water outlet 12 is shown. When a tap downstream from the hot water outlet is opened, the water in the hot water heater begins to flow. Cold water enters the hot water heater from the cold water inlet 10, which is preferably a standard three quarter inch pipe. Preferably, it passes through a pressure control valve 14 in communication with the cold water inlet 10 which helps maintain the water pressure in the system between 30 and 40 pounds per square inch. A check valve 16 also in communication with the inlet 10 prevents back flow from the hot water heater. The check valve 16 is often a municipal code requirement for hot water heaters.

In a preferred embodiment, the cold water enters the first of three heating chambers generally designated by the reference numeral 18. The first heating chamber 18 can comprise a tube 20 of standard one inch pipe having a first end 22 and a second end 24. Preferably, the tube 20 is positioned in an upright position with the first end 22 at the top.

The first end 22 includes a pressure switch 26. The second end 24 includes a heating element 28 which is preferably mounted on a base 30 which threadably engages the second end 24. Heating element 28 has preferably 4500 watts of heating power. The foregoing wattage number is merely a preferred value. Other values could be employed depending on the projected water usage. Such needed wattages can be readily determined using known equations and are not further discussed here.

The cold water, after flowing through check valve 16, enters the first heating chamber 18 via a three quarter inch to one inch inlet connection 32 approximately one quarter to one third of the length of the tube 20 as measured from the second end 24. The cold water is heated by the heating element 28 and flows up the tube 20 to an one inch to half inch outlet connection 34 mounted at the first end 22 of the tube 20 proximate to the pressure switch 26. From there, the heated water enters a half inch copper pipe 36.

The half inch pipe 36 directs the heated water to a second heating chamber 38. The second heating chamber 38 is constructed as the first heating chamber 18 except that the water inlets and outlets are positionally reversed. The heated water now enters the second heating chamber 38 through a half inch to one inch inlet connection 40 at the first end 42 of the second heating chamber 38 and exits via a one inch to half inch outlet connection 44 located approximately one quarter to one third along the length of the second heating chamber 38 as measured from a second end 46.

The second heating chamber 38 includes a pressure switch 48 and a heating element 50 positioned as in the first heating chamber 18. The heating element 50 in the second heating chamber 38 is also preferably about 4500 watts.

The second heating chamber outlet connection 44 preferably directs the heated water to a third heating chamber 52 which is constructed as the first heating chamber 18 except for the one half inch to one inch inlet connection 54, a 2000 watt heating element 56 and a pressure valve 58, instead of a pressure switch, mounted at a first end 60. The one inch to half inch outlet connection 62 mounted at the first end 60 allows the heated water to flow from the hot water heater via the hot water outlet 12 for use.

The pressure relief valve 58 is included as a safety mechanism. If the temperature within the hot water heater exceeds an upper limit, generally 150° F., the pressure relief valve 58 will open to release pressure from the system. This type of safety mechanism is also often a requirement of municipal building codes.

Figure 2:
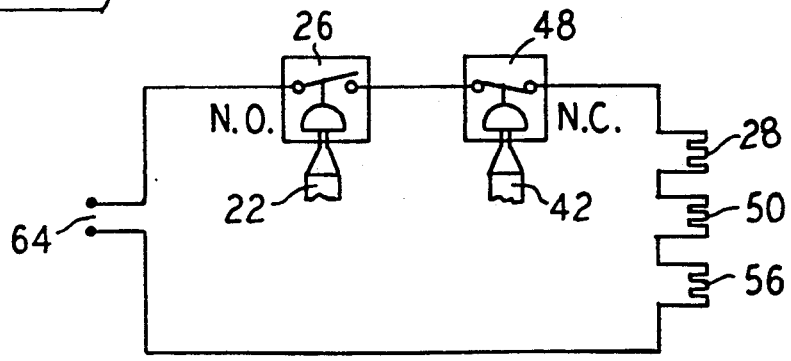
FIG. 2 is a schematic diagram of the circuitry of a preferred embodiment.

As shown in FIG. 2, a control means comprising the pressure switches 26 and 48 is mounted between an electrical power source 64 and the heating elements 28, 50 and 56. The control means supplies power to the heating elements 28, 50 and 56 only when the pressure is between a first threshold pressure and a second threshold. The activation state of pressure switch 26 depends only on the first threshold pressure. The activation state of the other pressure switch 48 depends only on the second threshold pressure. The first threshold pressure is at a lower pressure than the second threshold pressure but is lower than the pressure of the incoming water that flows through the cold water inlet 10, typically about forty pounds per square inch.

When a tap is opened downstream from the hot water outlet 12, the water pressure within the hot water heater will drop as the water begins to flow. Preferably, at about thirty-eight pounds per square inch, the first threshold pressure switch is closed. This will connect the heating elements 28, 50 and 56 to an electrical power source and begin heating the water flowing through the hot water heater.

Once the tap is closed, the water pressure will return to a typical pressure of forty pounds per square inch and the first threshold pressure switch again change its activation state, by opening thus shutting off the heating elements 28, 50 and 56.

The second threshold pressure switch is a safety mechanism to prevent overheating in the event that the pressure drops below a predetermined low threshold pressure, preferably set at about thirty four pounds per square inch. Once the pressure falls below the second threshold pressure, the second pressure switch will change its activation state by opening. The second threshold pressure switch is used to prevent low pressure problems which could be encountered in the event the hot water heater or the water supply system began leaking or if the flow of incoming water was substantially reduced or under an unusually low pressure. This prevents dangerous overheating which could damage the hot water heater or its surroundings.

In addition, a high temperature cut-off switch could be added, but need not be, to the system for added protection. Some building codes may require the addition of this feature to the hot water heater.

Many variations of this basic construction will be apparent to those skilled in the art. The dimensions of the pipes and the choice of materials are obvious possible variations.

Also, the number of tubes may be varied depending on the projected use. It is relatively easy to add or remove tubes and heating elements as needed if the usage and volume requirements change. The appropriate heating power needed is a straightforward calculation by those skilled in the art.

In an alternative embodiment, as the tubes are relatively small in dimensions, the units could be situated throughout a building, perhaps between the studs, near the hot water taps as needed. This would eliminate the need for one large unit to supply the entire building. This would reduce wasted water lost as a user waits for the water to reach the tap from the large unit. It would also provide faster hot water service to each tap.

The foregoing is illustrative of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed is:

1. An on-demand hot water heater comprising:

a) water heating chamber means having an inlet and an outlet and a flow path therebetween;

b) electrical heating element means disposed in said chamber means;

c) a first pressure responsive electrical switch means associated with said chamber means which is normally open and which closes when the pressure of water flowing through said chamber means falls below a first predetermined value which is less then the pressure of water entering said inlet;

d) a second pressure responsive electrical switch means associated with said chamber means which is normally closed and which opens when the pressure of water flowing through said chamber means falls below a second predetermined value which is less than said first predetermined value; and e) electrical conduit means for interconnecting said heating element means with said first and said second switch means and for associating such heating element means and said first and second switch means with a source of electrical power; so that said heating element means is electrically energized only when water pressure in said chamber means is between said first and said second predetermined values.

2. An on-demand hot water heater comprising:

a) a plurality of elongated water heating chambers, each one including an electrical heating element disposed therein, said chambers being interconnected together in series by conduit means, a first of said chambers having an inlet means and a last of said chambers having an outlet means;

b) valve means limiting the pressure of water entering said inlet means to a predetermined initial value;

c) two pressure sensitive electrical switch means, a first of said switch means sensing water pressure in said heating chambers at location downstream from said inlet means, said first switch means being normally open but which closes when said so sensed water pressure is below a first predetermined value that is below said initial value, and the second of said switch means sensing water pressure in said heating chambers at a location downstream from said first switch means and upstream from said outlet means, said second switch means being normally closed but which opens when said so sensed water pressure is above a below a second predetermined value that is below said first predetermined value; and d) electrical conduit means serially interconnecting together said electrical heating elements and said two pressure sensitive electrical switch means for functional association thereof with an electrical power source; so that, when said so sensed water pressure is below said first predetermined value and above said second predetermined value, said electrical heating elements are energized when said conduit means is so associated with a said power source.

* * * * *